US008087631B1

(12) United States Patent
Gretz

(10) Patent No.: US 8,087,631 B1
(45) Date of Patent: Jan. 3, 2012

(54) ADJUSTABLE MOUNTING BRACKET FOR SUSPENDED CEILING

(75) Inventor: Thomas J. Gretz, Clarks Summit, PA (US)

(73) Assignee: Arlington Industries, Inc., Scranton, PA (US)

( * ) Notice: Subject to any disclaimer, the term of this patent is extended or adjusted under 35 U.S.C. 154(b) by 1784 days.

(21) Appl. No.: 11/089,386

(22) Filed: Mar. 24, 2005

(51) Int. Cl.
*A47H 1/10* (2006.01)

(52) U.S. Cl. ..... 248/326; 248/343; 248/906; 220/3.9; 52/39

(58) Field of Classification Search ..... 248/343, 248/323, 906, 342, 326, 317, 413; 52/28, 52/39, 98; 220/3.2, 3.9
See application file for complete search history.

(56) References Cited

U.S. PATENT DOCUMENTS 406,196 A * 7/1889 Clayton et al. ..... 248/413
5,085,393 A 2/1992 Ryan
5,435,514 A * 7/1995 Kerr, Jr. ..... 248/343
5,938,157 A * 8/1999 Reiker ..... 248/200.1
6,033,098 A * 3/2000 Hentz et al. ..... 362/430
6,315,428 B1 11/2001 Chiang
6,332,597 B1 * 12/2001 Korcz et al. ..... 248/343
6,345,800 B1 2/2002 Herst et al.
6,889,943 B2 * 5/2005 Dinh et al. ..... 248/343

* cited by examiner

*Primary Examiner* — Terrell McKinnon
*Assistant Examiner* — Bradley Duckworth

(57) ABSTRACT

A load bearing assembly for supporting a lighting or fan fixture on a drop ceiling having a grid supporting structure. The assembly includes a single center bar, two end brackets with widely spaced support legs, and an electrical box. The support legs include removable portions that allow rapid modification to accommodate ceiling tiles of uniform thickness or ceiling tiles having a stepped edge. By adjusting the length of the legs, the lower surface of the tiles is leveled with the lower edge of the electrical box for either tiles of uniform thickness or those having stepped edges. A fastening arrangement enables adjustment of the end brackets with respect to the center bar, thereby allowing rapid fitting to adjacent T-rails. A locking arrangement enables easy adjustment of the location of the electrical box along the length of the center bar, thereby allowing the assembly to be rapidly fitted to a desired location on a drop ceiling.

7 Claims, 7 Drawing Sheets

ADJUSTABLE MOUNTING BRACKET FOR SUSPENDED CEILING

FIELD OF THE INVENTION

This invention relates to load bearing hangers for overhead electrical boxes and specifically to an improved load bearing assembly that is easy to install and provides improved stability against vibration.

BACKGROUND OF THE INVENTION

Hanger assemblies are commonly used for supporting lighting or fan fixtures from drop ceilings. One such hanger assembly is shown in U.S. Pat. No. 5,435,514 issued to Kerr, Jr. The hanger assembly of Kerr, Jr. includes a first and second elongated and a bracket of an inverted U-shape configuration. The bracket includes a bottom wall with a transverse recess for receiving the first elongated bar and spaced apart flanges upstanding from the bottom wall for receiving the second elongated bar. Bolts through the bottom wall of the bracket secure the bracket to an electrical box and also sandwich the first bar between the transverse recess and the box. Another bolt extends transversely through the flanges and can be tightened to draw together the flanges and secure the second bar between the two flanges. Foot mounts are attached to both ends of the first bar and one end of the second bar for resting on the rails of a lattice framework for a drop ceiling.

The Kerr Jr. hanger assembly suffers from several disadvantages. First, two bars must be used for supporting a fixture. For adjusting to the desired position on the lattice framework, both the first and second bars must be loosened and manipulated, including the loosening and tightening of two sets of bolts. Second, the electrical box is difficult to level as a result of the use of circular bars, a semicircular recess for accepting the first bar, the second bar being held between two parallel flanges, and foot mounts simply pressed onto the ends of the bars. Any loosening of the central bolts could easily cause the electrical box to twist around one or both of the circular bars thereby throwing the electrical box out of a level orientation. A further disadvantage is that the load bolts for supporting the fixture are held by the electrical box, therefore causing all the static load of the suspended fixture to bear directly on the electrical box.

Another disadvantage of the Kerr, Jr. hanger assembly and other prior art hanger assemblies is the lack of a mechanism for quickly leveling the electrical box for either uniform thickness ceiling tiles or those having a stepped edge.

SUMMARY OF THE INVENTION

The invention is a load bearing assembly for supporting a lighting or fan fixture on a drop ceiling having a grid supporting structure. The assembly includes a single center bar, two end brackets with widely spaced support legs, and an electrical box. The support legs include removable portions that allow rapid modification to accommodate ceiling tiles of uniform thickness or ceiling tiles having a stepped edge. By adjusting the length of the legs, the lower surface of the tiles is leveled with the lower edge of the electrical box for either tiles of uniform thickness or those having stepped edges. A fastening arrangement enables adjustment of the end brackets with respect to the center bar, thereby allowing rapid fitting to adjacent T-rails. A locking arrangement enables easy adjustment of the location of the electrical box along the length of the center bar, thereby allowing the assembly to be rapidly fitted to a desired location on a drop ceiling.

OBJECTS AND ADVANTAGES

The load bearing assembly of the present invention includes features that simplify installation. A fastening arrangement provides an easy aligning feature for rapid fitting the assembly between two adjacent T-rails of an overhead grid system. A locking arrangement provides an easy method for adjusting the electrical box to any desired location between the T-rails. The combination of the fastening and locking arrangements of the load bearing assembly greatly simplify the task of installing an electrical box on a drop ceiling for the support of a lighting or fan fixture.

A further advantage is that superior load bearing ability is achieved by providing a center bracket that extends around substantially the entire outer periphery of the center bar. By utilizing a single center bar, simplicity is achieved over prior art bars that include three arms or two cross bars.

Substantially long end brackets and widely spaced support legs enable the load bearing assembly to better support lighting and fan fixtures against vibration and torque.

A further advantage is that the weight of a lighting or fan fixture is supported by structurally sound portions of the assembly, such as the center bracket, instead of being supported by the electrical box, whose walls are not typically built to bear the weight of a suspended fixture. Thus the weight of the suspended fixture is supported by the center bracket and the bar, rather than by the electrical box.

A further advantage is that, as a result of the tubular bar and stubs of the end brackets being of rectangular cross section and the center mounting bracket fitting substantially around the outer periphery of the bar, the electrical box is kept level with the bar and the bar kept level with the end brackets. Loosening of the locking arrangement does not affect the level of the electrical box as the center bracket maintains level with the box and bar as it is slid across the bar. Loosening of the fastening arrangement for adjusting the end brackets also does not affect the level of the electrical box or bar with respect to the end brackets or rails, as the rectangular shaped stubs are received in the rectangular shaped bar.

Yet another advantage of the load bearing assembly of the present invention is its ability to rapidly be modified to accept either uniform thickness ceiling tiles or those having a stepped edge. This is accomplished by the inclusion of removable end portions on the support legs of the end brackets.

These and other objects and advantages of the present invention will be better understood by reading the following description along with reference to the drawings.

TABLE OF NOMENCLATURE

Figure 1:
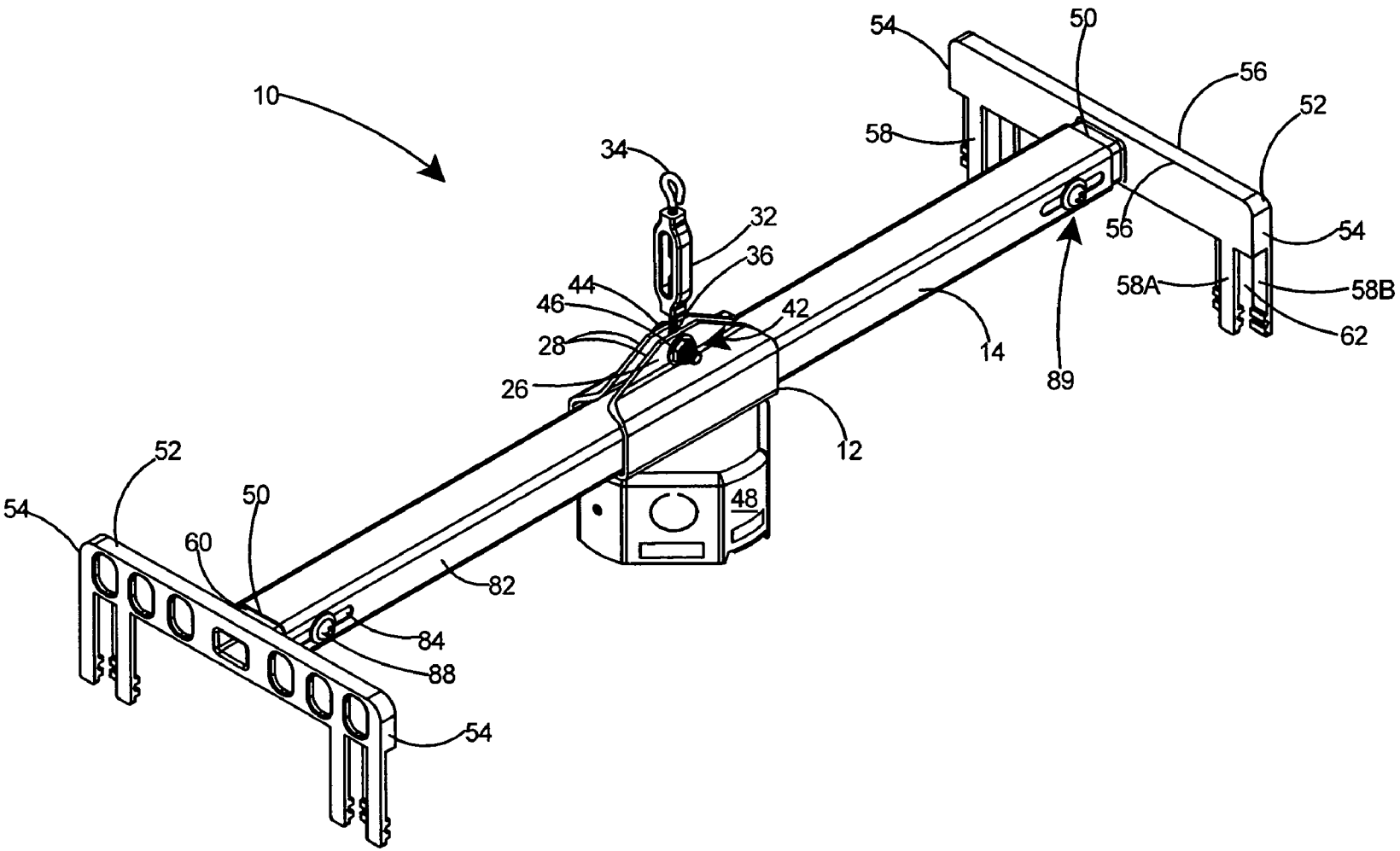
FIG. 1 is a perspective view of a preferred embodiment of a load bearing assembly for supporting a lighting or fan fixture according to the present invention.
Figure 2:
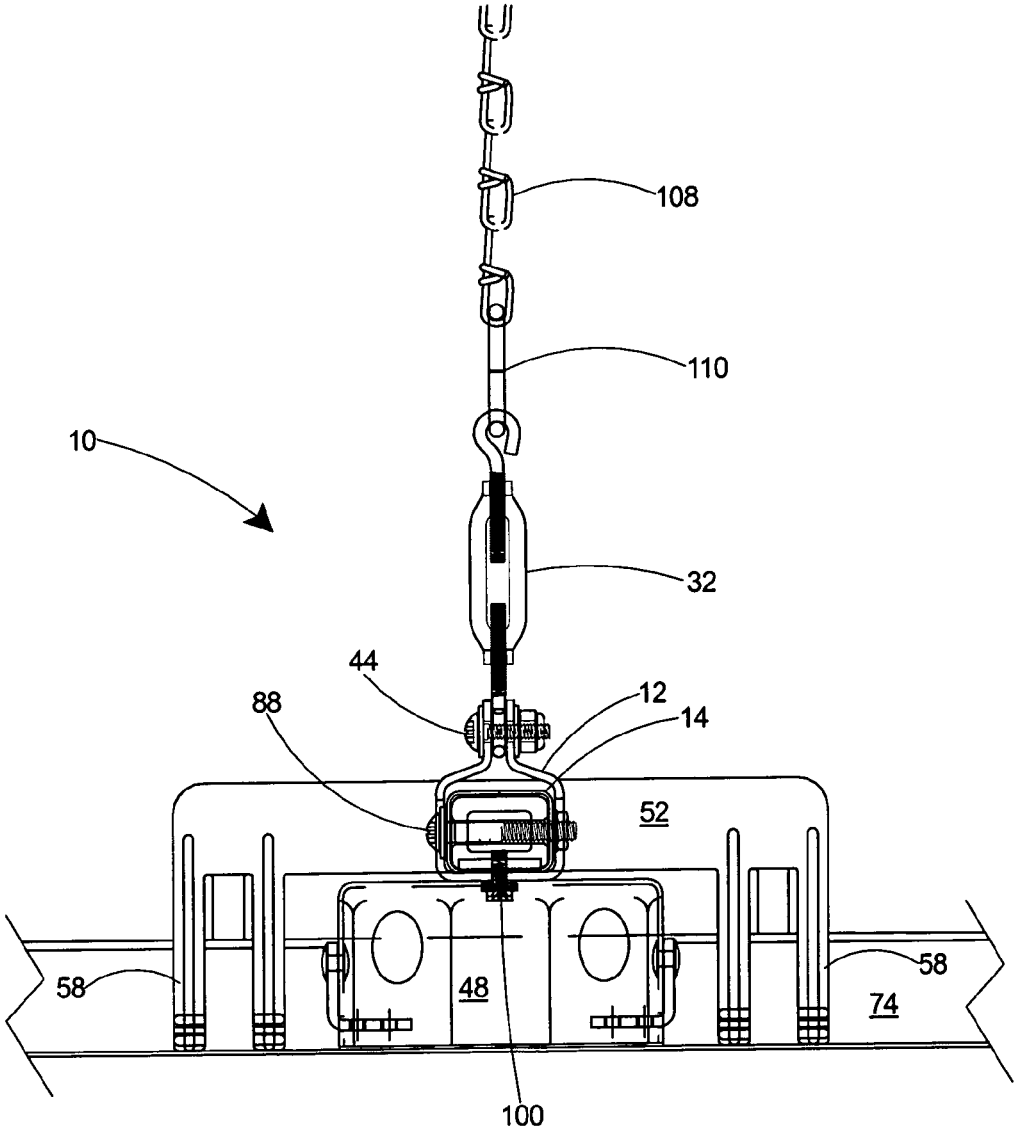
FIG. 2 is an end view of a portion of the load bearing assembly taken along line 2-2 of FIG. 1.

The following is a listing of part numbers used in the drawings along with a brief description:

| Part Number | Description |
|---|---|
| 10 | load bearing assembly |
| 12 | center bracket |
| 14 | elongated tubular bar |
| 16 | central channel of center bracket |
| 18 | top portion of center bracket |
| 20 | bottom portion of center bracket |
| 22 | opening |
| 24 | sides of top portion |
| 26 | wing |
| 28 | opposing wings |
| 30 | aperture in wing |
| 32 | turnbuckle |
| 34 | upper end of turnbuckle |
| 36 | lower end of turnbuckle |
| 38 | hook |
| 40 | opening in hook |
| 42 | bracket fastener |
| 44 | threaded fastener |
| 46 | nut |
| 48 | electrical box |
| 50 | ends of tubular bar |
| 52 | end bracket |
| 54 | end of end bracket |
| 56 | side of end bracket |
| 58 | support leg |
| 58A | support leg on one side |
| 58B | support leg on opposite side |
| 60 | stub |
| 61 | channel of tubular bar |
| 62 | gap |
| 64 | lower end of support leg |
| 66 | inner surface of support leg |
| 67 | nub |
| 68 | notch |
| 70 | removable end portion |
| 72 | planar lower edge |
| 74 | T-rail |
| 76 | lower surface of ceiling tile |
| 78 | ceiling tile of uniform thickness |
| 80 | stepped edge ceiling tile |
| 82 | side walls of tubular bar |
| 84 | longitudinal slots |
| 86 | threaded bores in end brackets |
| 88 | threaded fasteners |
| 89 | fastening arrangement |
| 90 | lower wall of center bracket |
| 92 | longitudinal slot in tubular bar |
| 94 | lips |
| 96 | bracket back plate |
| 98 | fastener |
| 100 | adjustment fastener |
| 102 | locking arrangement |
| 104 | shipping configuration |
| 106 | horizontal shelf of T-rail |

-continued

| Part Number | Description |
|---|---|
| 108 | chain |
| 110 | S-hook |
| X | distance of notch above lower end of support leg |

DETAILED DESCRIPTION OF THE INVENTION

The present invention comprises a load bearing assembly for supporting a lighting or fan fixture on a drop ceiling.

With reference to FIG. 1, a preferred embodiment of a load bearing assembly 10 includes a one-piece center bracket 12 and an elongated tubular bar 14. The elongated tubular bar 14 extends through the central channel 16.

Figure 4:
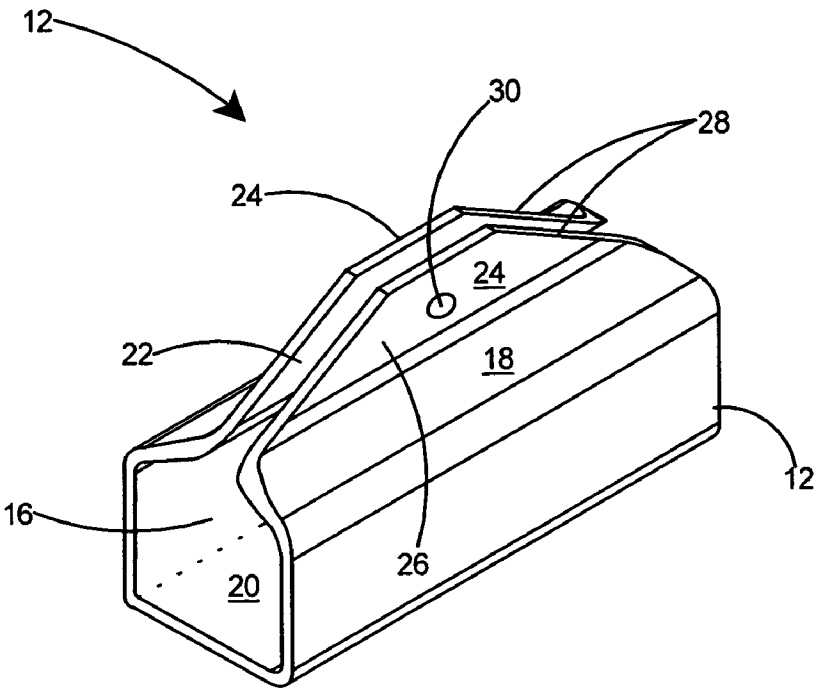
FIG. 4 is a perspective view of a center bracket portion of the load bearing assembly of FIG. 1.

Referring to FIG. 4, the center bracket 12 includes a central channel 16, a top portion 18, and a bottom portion 20. An opening 22 extends longitudinally along the top portion 18 of the center bracket 12 thereby forming two sides 24 at the opening 22. A wing 26 extends upward from each side 24 of the top portion 18 at the opening 22 thereby forming opposing wings 28 in opposing planes equidistant to one another. Each of the wings 28 includes an aperture 30, with the apertures 30 therein in axial alignment.

Figure 5:
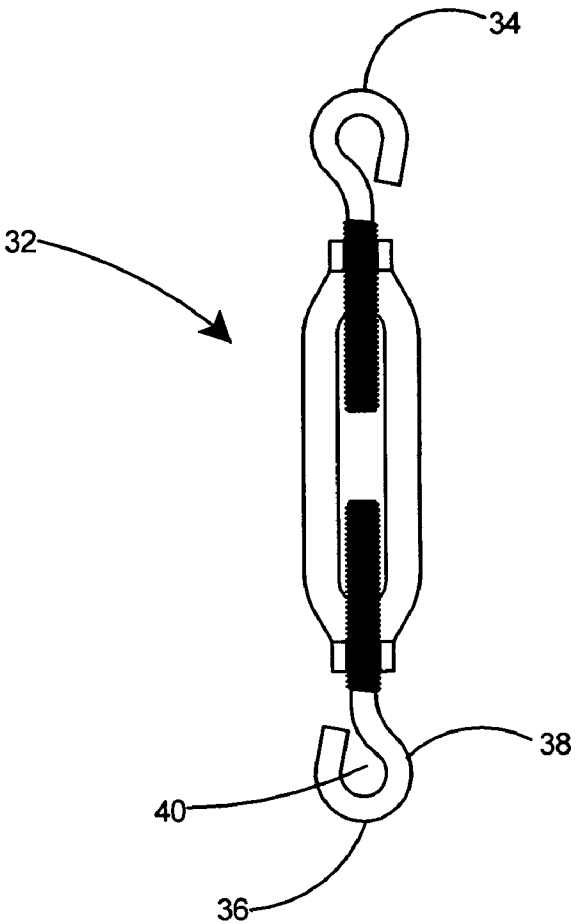
FIG. 5 is a side view of a turnbuckle portion of the load bearing assembly of FIG. 1.

As shown in FIG. 1, a turnbuckle 32 having an upper end 34 and a lower end 36 is pivotally attached at its lower end 36 to the center bracket 12. With reference to FIG. 5, the lower end 36 of the turnbuckle includes a hook 38 with an opening 40 therein.

Referring to FIGS. 1, 4 and 5, the hook 38 is placed between the opposing wings 28 and a bracket fastener 42, typically consisting of a threaded fastener 44 and a nut 46, is fastened through the axially aligned apertures 30 in the wings 26 and the opening 40 of the hook 38. In a loosened state, the bracket fastener 42 enables pivoting of the turnbuckle 32 to a position longitudinal with respect to the tubular bar 14 (see FIG. 3A). The center bracket 12 extends a substantial distance along the tubular bar 14. An electrical box 48 is secured to the bottom portion 20 of the center bracket 12.

Figure 6:
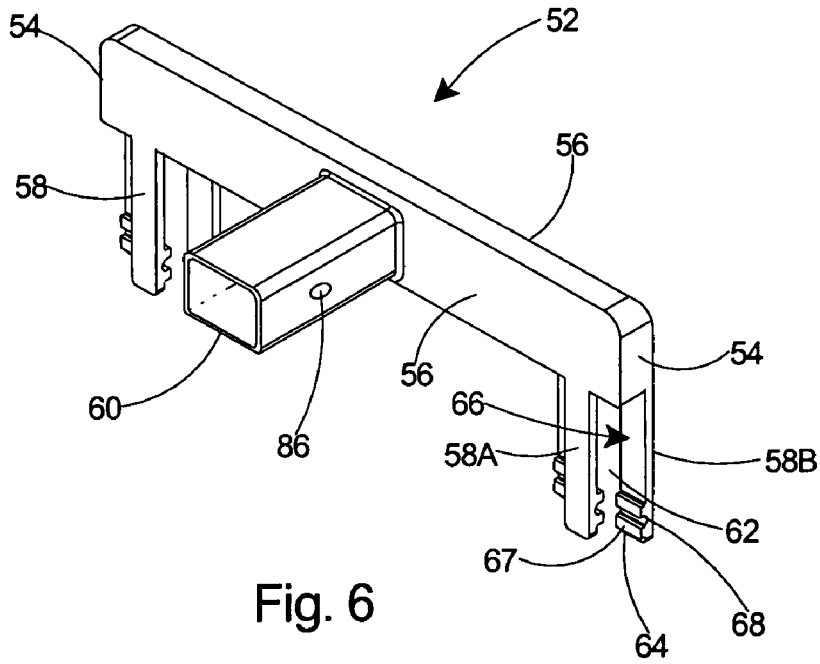
FIG. 6 is a perspective view of an end bracket portion of the load bearing assembly of FIG. 1.

With reference to FIGS. 1 and 6, the tubular bar 14 includes two ends 50 and an elongated end bracket 52 at each end 50. The end bracket 52 includes two ends 54 and two sides 56 with support legs 58 extending downwards from the ends 54 of each end bracket 52. A stub 60 extends from a side 56 of the end brackets 52. The stubs 60 of the end brackets 52 are received within the channel 61 (see FIG. 9A) of the tubular bar 14 and are slideable with respect to the bar. With the load bearing assembly 10 fully assembled, as shown in FIG. 1, the end brackets 52 are normal to the tubular bar 14.

Figure 3A:
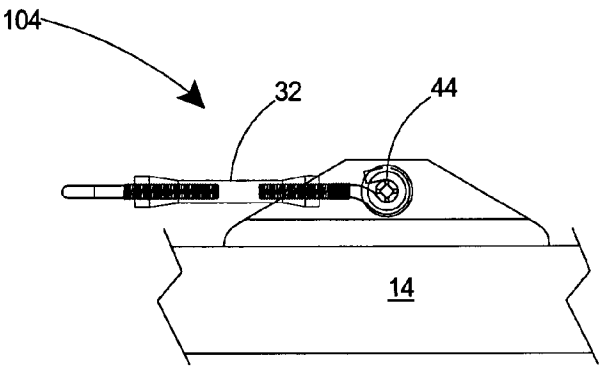
FIG. 3A is a side view of the turnbuckle portion of the load bearing assembly in a configuration appropriate for shipping.
Figure 3:
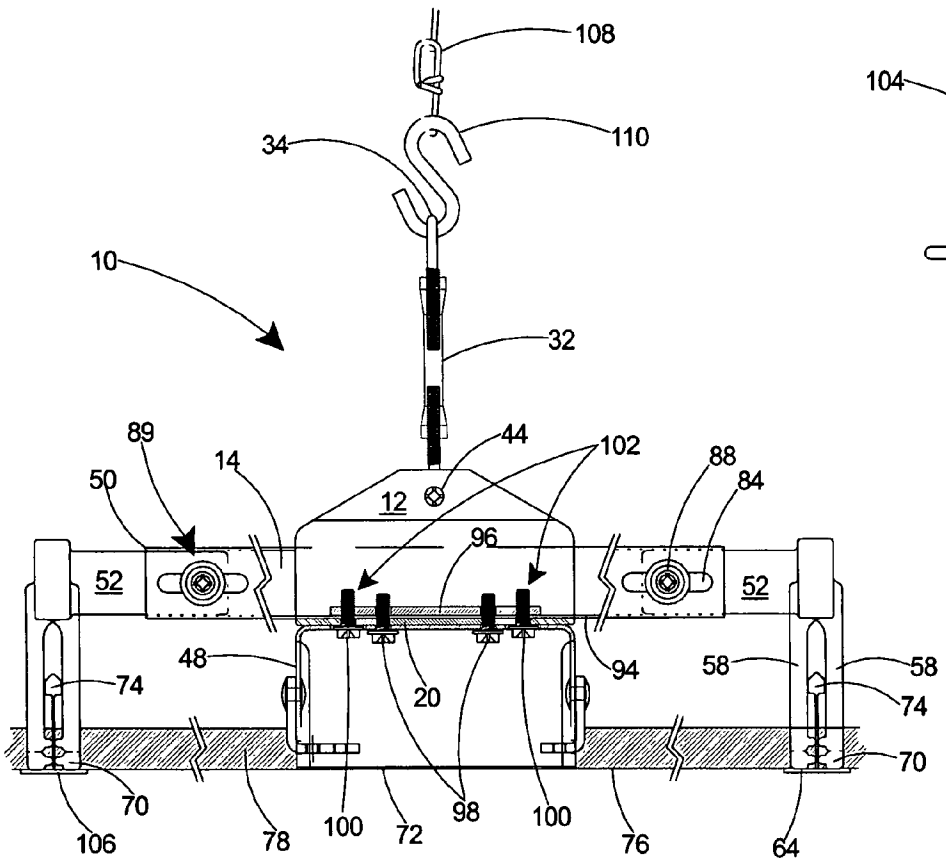
FIG. 3 is a side view of the load bearing assembly of FIG. 1 fitted upon the T-rails of a grid supporting structure for a drop ceiling shown supporting a ceiling tile of uniform thickness.
Figure 7:
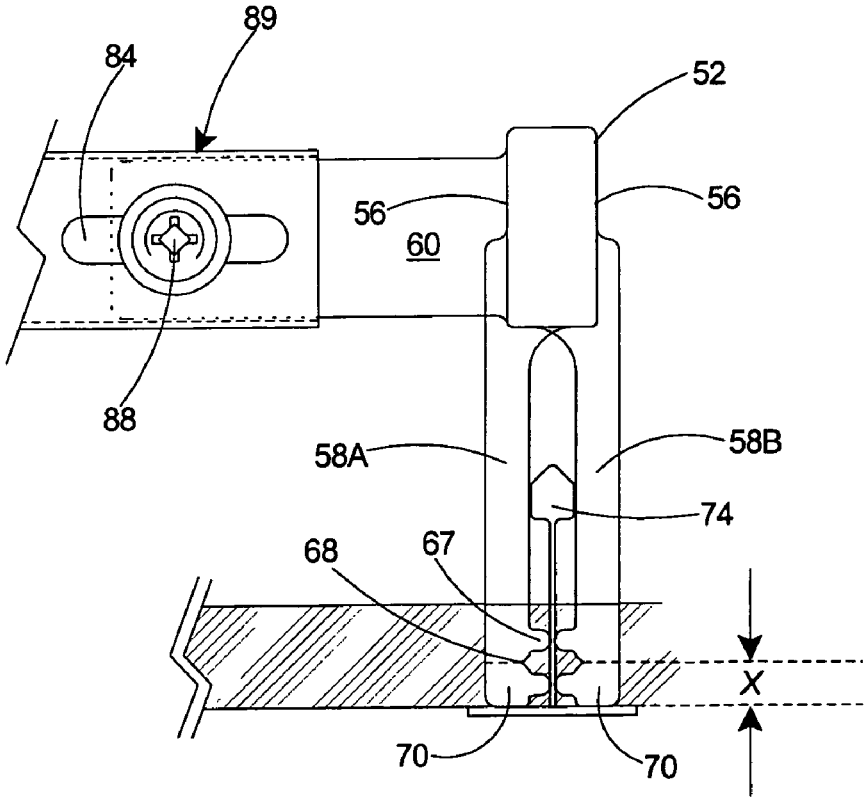
FIG. 7 is a side view of a portion of an end bracket and the connected tubular bar shown in FIG. 3.

With reference to FIGS. 6 and 7, at least two support legs 58 extend from each of the ends 54 of the end bracket 52. The support legs 58 on each end 54 extend from opposite sides 56 of the end bracket 52 thereby forming opposing support legs 58A, 58B. A gap 62 is formed on each end 54 of the end bracket 52 between each of the opposing support legs 58A, 58B. The support legs 58 include lower ends 64, inner surfaces 66, and nubs 67 extending from the inner surfaces 66. Notches 68 are provided in the support legs 58 and are located a first distance X above the support leg lower ends 64. The notches 68 create removable end portions 70 on the support leg lower ends 64. The first distance is preferably 0.25 inch. Two types of ceiling tiles are commonly used in drop ceilings. A first type, such as shown in FIG. 3, is of a constant thickness throughout its length and width. A second type (not shown) includes a 0.25-inch stepped edge around its outer perimeter.

Figure 8:
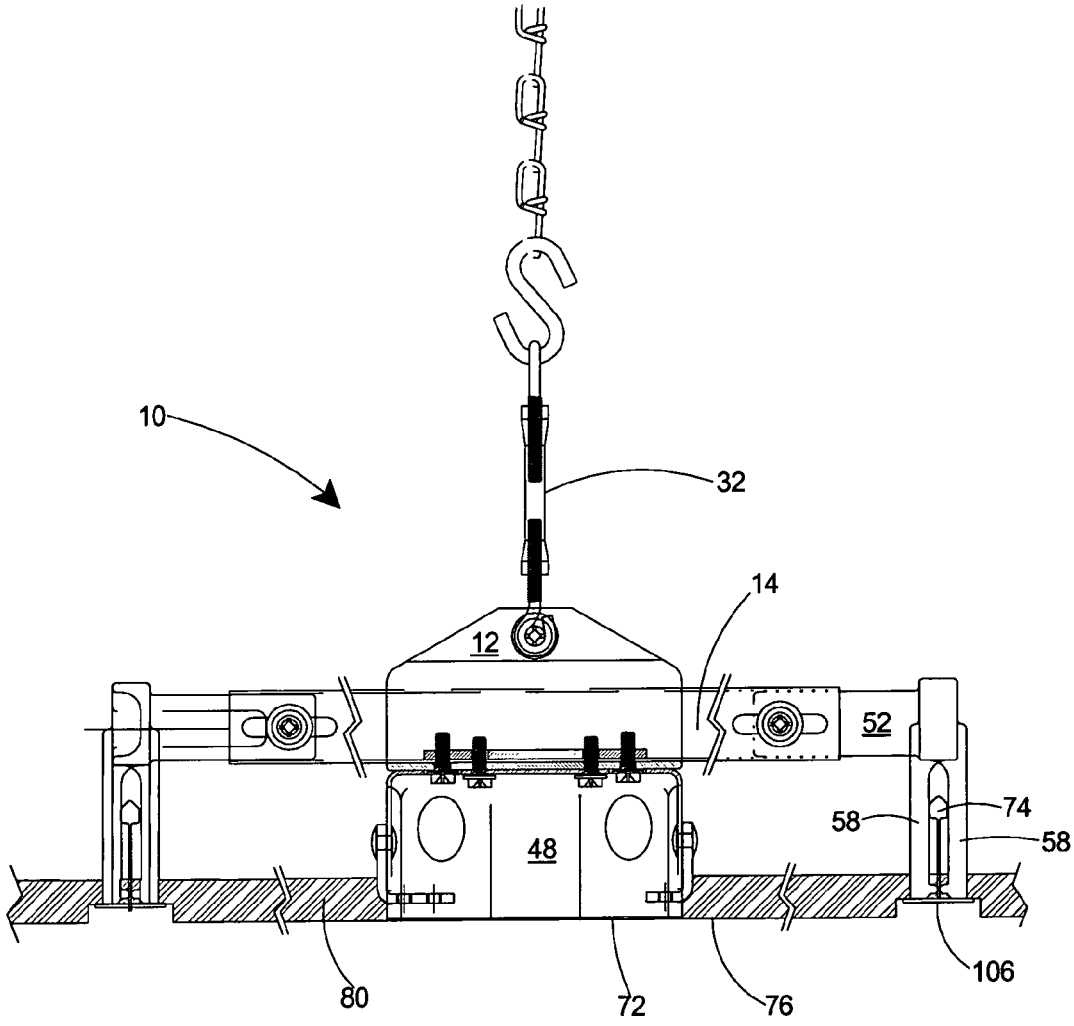
FIG. 8 is a side view of the load bearing assembly of FIG. 1 fitted upon the T-rails of a grid supporting structure for a drop ceiling shown supporting a stepped ceiling tile.

The removable end portions 70 are provided for leveling the electrical box with the lower surface of a ceiling constructed with ceiling tile having a stepped edge. As shown in FIG. 3, the electrical box 48 includes a planar lower edge 72 that, with the removable end portions 70 intact, is even with the lower ends 64 of the support legs 58. Therefore, when the load bearing assembly 10 is lowered onto adjacent T-rails 74 of a grid supporting structure, the planar lower edge 72 is even with the lower surface 76 of a ceiling tile 78 of constant thickness throughout. If the load bearing assembly 10 is used with a ceiling tile 80 having a stepped edge, such as shown in FIG. 8, the removable end portions 70 (see FIG. 7) are removed, which positions the planar lower edge 72 of the electrical box 48 even with the lower surface 76 of the stepped edge ceiling tile 80.

Referring to FIG. 1, for the connection of the end brackets 52 to the tubular bar 14, it should be noted that the tubular bar 14 includes side walls 82 and longitudinal slots 84 in the side walls 82 near each end 50 of the bar. As shown in FIG. 6, the stubs 60 of the end brackets 52 include threaded bores 86 therein. As shown in FIGS. 1 and 7, threaded fasteners 88 extend through the slots 84 and into the threaded bores 86 in the end bracket stubs 60. The threaded fasteners 88 extending through the slots 84 in the tubular bar 14 and into the stub 60 provide a fastening arrangement 89 for limiting the slideable distance of the stubs 60 within the tubular bar 14. The threaded fasteners 88 may be partially tightened into the threaded bores 86 to enable the end brackets 52 to be slideable with respect to the tubular bar 14. T-rails 74 in the grid supporting structure of a drop ceiling are typically spaced 2 feet apart to accommodate most standard 2-foot ceiling tiles. However, in the installation of the grid supporting structure, any two adjacent T-rails 74 may be slightly more or less than the nominal 2-foot separation. The slideability of the end brackets 52 with respect to the tubular bar 14 therefore provides a convenient and simple means of adjusting the length of the load bearing assembly 10 to fit between any two adjacent T-rails 74. The slots are preferably 1.26 inches in length, which allows an adjustment in the length of the load bearing assembly by at least 2.0 inches by manipulation of the two fasteners 88.

Figure 9:
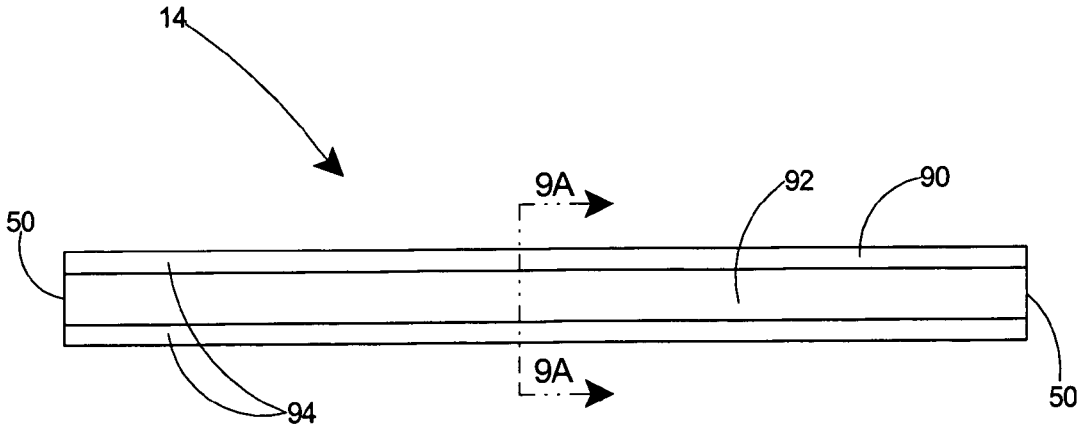
FIG. 9 is a bottom view of the tubular bar portion of the load bearing assembly of FIG. 1.
Figure 9A:
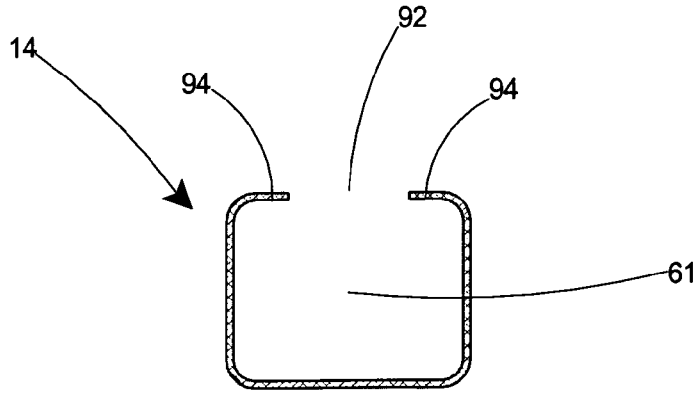
FIG. 9A is a sectional view of the tubular bar taken along line 9A-9A of FIG. 9.

Referring to FIGS. 9 and 9A, the tubular bar 14 includes a lower wall 90 and a longitudinal slot 92 along its length. Parallel lips 94 surround the longitudinal slot 92. With reference to FIG. 3, a bracket back plate 96 is included within the tubular bar 14 and resting on the lips 94. A first set of fasteners 98 secure the electrical box 48 to the center bracket 12. A second set of adjustment fasteners 100 extend through the longitudinal slot (not shown) and connect the bottom portion 20 of the center bracket 12 to the bracket back plate 96. The adjustment fasteners 100 provide a locking arrangement 102 for securing the electrical box 48 and the center bracket 12 with respect to the tubular bar 14. The adjustment fasteners 100 in a loosened state enables sliding of the electrical box 48 longitudinally along the tubular bar 14. Placing the adjustment fasteners 100 in a tightened state locks the electrical box 48 with respect to the tubular bar 14.

The load bearing assembly 10 includes an operational configuration in which the turnbuckle 32 is locked vertically upwards with respect to the tubular bar 14, such as shown in FIG. 3. Alternatively, as shown in FIG. 3A, the load bearing assembly 10 includes a shipping configuration 104 in which the turnbuckle 32 is locked horizontally with respect to the tubular bar 14. The shipping configuration 104 greatly reduces the overall profile of the load bearing assembly and allows it to be shipped in a more compact package.

The load bearing assembly 10 of the present invention is provided fully assembled in one piece. It is typically packed in a box with the turnbuckle rotated to the shipping configuration, as shown in FIG. 3A. To prepare for installation on the T-rails of a grid supporting structure, the turnbuckle 32 it rotated to its vertical position, as shown in FIG. 1. The installer selects a desired grid location for the lighting or fan fixture (not shown) that will be supported by the load bearing assembly. With reference to FIG. 3, one or both of the threaded fasteners 88 of the fastening arrangement 89 are loosened and the end brackets 52 slid into the tubular bar 14 until the separation between the end brackets 52 match the separation between the T-rails 74. The fastening arrangement 89 is then tightened to lock the end brackets 52 with respect to the tubular bar 14. The downward depending support legs 58 are then aligned with the T-rails 74 of the selected grid location and the load bearing assembly 10 pressed downwards until the support legs 58 seat on the horizontal shelf 106 of the T-rails 74. The center bracket 12 and the electrical box 48 are then slid to the desired location on the tubular bar 14 and the locking arrangement 102 tightened to secure the electrical box 48 and the center bracket 12 to the tubular bar 14. The load bearing assembly 10 is then secured to an overhead support structure (not shown) by connecting a chain 108 with an S-hook 110 to the upper end 34 of the turnbuckle 32. The height of the load bearing assembly 10 may then be adjusted slightly up or down by turning the turnbuckle 32 until the planar lower edge 72 of the electrical box 48 is approximately even with the lower surface 76 of the ceiling tile 78.

If the load bearing assembly 10 is used with a stepped edge ceiling tile 80, as shown in FIG. 8, the removable end portions 70 are removed by cutting at the notches 68 (see FIG. 7). The end brackets 52 are typically molded in one piece of plastic, and the end brackets 52 can easily be removed by using the notches 68 as a guide and cutting through with a knife or similar sharp edged tool. The load bearing assembly 10 is then lowered onto the support rails 74 until the shortened support legs 58 contact the horizontal shelf 106 of the T-rails 74. The remaining steps for installing the load bearing assembly 10 are the same as described in the previous paragraph. The shortened support legs place the planar lower edge 72 of the electrical box 48 level with the lower surface 76 of the stepped edge ceiling tile 80.

With reference to FIG. 3, the tubular bar 14, center bracket 12, and electrical box 48 are preferably constructed of metal to support the weight of the lighting or fan fixture. The fastening arrangement 89 provides an easy aligning feature for rapid fitting to two adjacent T-rails. The center bracket 12, by extending around substantially the entire outer periphery of the tubular bar 14, provides superior load bearing ability. The locking arrangement 102 provides an easy method for adjusting the electrical box 48 to any desired location along the length of the tubular bar 14. By providing end brackets 52 having a substantial length, the support legs 58 are spaced wide on the support rails thereby better supporting the load bearing assembly 10 against vibration and torque, such as that caused by a ceiling fan supported therefrom. By employing a single tubular bar, the load bearing assembly 10 of the present invention is simpler to install than fixture supports having three arms or two cross bars.

Having thus described the invention with reference to a preferred embodiment, it is to be understood that the invention is not so limited by the description herein but is defined as follows by the appended claims.

What is claimed is:

1. A load bearing assembly for supporting a lighting or fan fixture on a drop ceiling comprising:

an elongated one-piece center bracket having a longitudinal central channel, a top portion, and a bottom portion;

a one-piece elongated tubular bar of rectangular cross section extending through said central channel, said tubular bar having two ends;

said bracket extending around the periphery of said tubular bar;

an elongated end bracket at each end of said tubular bar, said end bracket having two ends and two sides;

widely spaced support legs extending downwards from each of said ends of said end brackets;

a turnbuckle having an upper and a lower end;

said lower end of said turnbuckle pivotally attached to said center bracket;

said support legs include lower ends;

notches in said support legs located a first distance above said support leg lower ends;

said notches creating removable end portions on said support leg lower ends;

stubs of rectangular cross section extending from said sides of said end brackets, said stubs received within said tubular bar and slideable with respect to said bar;

a flat bracket back plate enclosed within said tubular bar; and an electrical box secured to said bottom portion of said center bracket.

2. The assembly of claim 1 wherein said center bracket extends a measurable distance along said bar.

3. The assembly of claim 1 including an opening extending longitudinally along said top portion of said center bracket;

two sides at said opening of said top portion; and a wing oriented longitudinally with respect to said tubular bar and extending upwards from each side of said top portion at said opening and thereby forming opposing wings planar to one another.

4. The assembly of claim 3 including an aperture in each of said wings, said apertures in axial alignment;

said lower end of said turnbuckle including a hook with an opening therein; and a bracket fastener through said wings and said opening of said hook;

whereby said bracket fastener in a loosened state enables pivoting of said turnbuckle longitudinally with respect to said tubular bar.

5. The assembly of claim 1 wherein said turnbuckle is capable of being pivoted longitudinally with respect to said tubular bar;

said assembly includes an operational configuration in which said turnbuckle is locked vertically upwards with respect to said tubular bar; and said assembly includes a shipping configuration in which said turnbuckle is locked horizontally and longitudinally with respect to said elongated tubular bar.

6. The assembly of claim 1 including a lower edge on said electrical box;

said lower edge of said electrical box level with said lower end of said support legs; and removing said removable end portions locates said lower edge of said electrical box below said lower ends of said support legs by said first distance.

7. The assembly of claim 1 wherein said tubular bar includes a rectangular shaped channel therein.

* * * * *